US009100764B2

(12) United States Patent
Solum et al.

(10) Patent No.: US 9,100,764 B2
(45) Date of Patent: Aug. 4, 2015

(54) SYSTEMS FOR PROVIDING POWER TO A HEARING ASSISTANCE DEVICE

(75) Inventors: Jeffrey Paul Solum, Deephaven, MN (US); Jorge Sanguino, Hopkins, MN (US)

(73) Assignee: Starkey Laboratory, Inc., Eden Prairie, MN (US)

( * ) Notice: Subject to any disclaimer, the term of this patent is extended or adjusted under 35 U.S.C. 154(b) by 2452 days.

(21) Appl. No.: 11/689,362

(22) Filed: Mar. 21, 2007

(65) Prior Publication Data

US 2008/0232623 A1 Sep. 25, 2008

(51) Int. Cl.
*H04R 25/00* (2006.01)

(52) U.S. Cl.
CPC ..... *H04R 25/602* (2013.01); *H04R 25/556* (2013.01); *H04R 2225/31* (2013.01); *H04R 2420/07* (2013.01)

(58) Field of Classification Search
CPC .. H04R 25/556; H04R 25/554; H04R 25/558; H04R 2225/021; H04R 2225/31; H04R 25/552; H04R 25/602; H04R 2225/67; H04R 25/02; H04R 5/033; A61N 1/36032; A61N 1/3787; A61N 1/08; A61N 1/3718; A61N 1/372
USPC ..... 381/312, 314, 322, 323, 330; 455/557, 455/556.2; 607/57
See application file for complete search history.

(56) References Cited

U.S. PATENT DOCUMENTS 3,493,695 A 2/1970 Stork
4,961,230 A * 10/1990 Rising ..... 381/323
5,389,009 A * 2/1995 Van Schenck, III ..... 439/500
5,502,769 A * 3/1996 Gilbertson ..... 381/309
5,515,443 A * 5/1996 Meyer ..... 381/314
(Continued)

FOREIGN PATENT DOCUMENTS

CH 673551 3/1990
EP 0789474 A2 8/1997
(Continued)

OTHER PUBLICATIONS

"European Application Serial No. 08250941.5, Extended European Search Report mailed Aug. 1, 2011", 4 pgs.
(Continued)

*Primary Examiner* — Davetta W Goins
*Assistant Examiner* — Phylesha Dabney
(74) *Attorney, Agent, or Firm* — Schwegman Lundberg & Woessner, P.A.

(57) ABSTRACT

Disclosed herein, among other things, is an apparatus for connection to a hearing assistance device having a DAI compatible interface compatible with direct audio input (DAI) signals. According to an embodiment, the apparatus includes a connector to connect to the DAI-compatible interface. The connector includes audio and ground connections compatible with the DAI-compatible interface. The connector further includes a power connection adapted to provide power to the hearing assistance device. The apparatus also includes a power source electrically connected to the connector. The power source is adapted to charge one or more energy storing devices, such as batteries, within the hearing assistance device, according to various embodiments. In an embodiment, the power source is adapted to supplement power provided to the hearing assistance device by the one or more energy storing devices within the device.

26 Claims, 9 Drawing Sheets

(56) References Cited

U.S. PATENT DOCUMENTS

| | | | | |
|---|---|---|---|---|
| 5,717,771 | A | 2/1998 | Sauer et al. | |
| 5,721,783 | A | 2/1998 | Anderson | |
| 6,078,825 | A | 6/2000 | Hahn et al. | |
| 6,144,748 | A | 11/2000 | Kerns | |
| 6,157,728 | A | 12/2000 | Tong et al. | |
| 6,319,020 | B1 * | 11/2001 | Brimhall et al. | 439/77 |
| 6,381,308 | B1 | 4/2002 | Cargo et al. | |
| 6,760,457 | B1 | 7/2004 | Bren et al. | |
| 6,888,948 | B2 * | 5/2005 | Hagen et al. | 381/314 |
| 7,054,957 | B2 * | 5/2006 | Armitage | 710/8 |
| 7,139,404 | B2 | 11/2006 | Feeley et al. | |
| 7,181,032 | B2 | 2/2007 | Jakob et al. | |
| 7,257,372 | B2 | 8/2007 | Kaltenbach et al. | |
| 7,787,647 | B2 * | 8/2010 | Hagen et al. | 381/314 |
| 7,813,762 | B2 | 10/2010 | Sanguino et al. | |
| 7,929,723 | B2 * | 4/2011 | Hagen et al. | 381/314 |
| 8,503,708 | B2 | 8/2013 | Galster et al. | |
| 2002/0090099 | A1 | 7/2002 | Hwang | |
| 2002/0131614 | A1 | 9/2002 | Jakob et al. | |
| 2003/0045283 | A1 | 3/2003 | Hagedoorn | |
| 2003/0133582 | A1 | 7/2003 | Niederdrank | |
| 2004/0010181 | A1 | 1/2004 | Feeley et al. | |
| 2004/0077387 | A1 | 4/2004 | Sayag et al. | |
| 2004/0136555 | A1 | 7/2004 | Enzmann | |
| 2004/0141628 | A1 | 7/2004 | Villaverde et al. | |
| 2004/0204921 | A1 | 10/2004 | Bye | |
| 2005/0008178 | A1 | 1/2005 | Joergensen et al. | |
| 2005/0209657 | A1 * | 9/2005 | Chung et al. | 607/57 |
| 2006/0039577 | A1 | 2/2006 | Sanguino et al. | |
| 2006/0068842 | A1 | 3/2006 | Sanguino et al. | |
| 2006/0245611 | A1 | 11/2006 | Jorgensen et al. | |
| 2007/0106344 | A1 * | 5/2007 | Darley et al. | 607/55 |
| 2008/0137888 | A1 * | 6/2008 | Newton et al. | 381/314 |
| 2008/0232623 | A1 | 9/2008 | Solum et al. | |
| 2008/0304686 | A1 * | 12/2008 | Meskens et al. | 381/330 |
| 2009/0067653 | A1 * | 3/2009 | Meskens et al. | 381/315 |
| 2011/0249837 | A1 | 10/2011 | Galster et al. | |

FOREIGN PATENT DOCUMENTS

| | | | |
|---|---|---|---|
| EP | 1973379 | B1 | 8/2012 |
| WO | WO-9931936 | | 6/1999 |
| WO | WO-03047310 | A1 | 6/2003 |
| WO | WO-2006023857 | A1 | 3/2006 |
| WO | WO-2006023920 | A1 | 3/2006 |

OTHER PUBLICATIONS

"European Application Serial No. 08250941.5, Response filed Mar. 15, 2011 to European Search Report mailed Sep. 20, 2010", 9 pgs.
"European Application Serial No. 08250941.5, Supplemental Response filed Mar. 21, 2011 to European Search report mailed Sep. 20, 2010", 2 pgs.
U.S. Appl. No. 12/982,526, Non Final Office Action mailed Oct. 24, 2012, 7 pgs.
"U.S. Appl. No. 11/207,591 Notice of Allowance mailed Jul. 1, 2010", 9 Pgs.
"U.S. Appl. No. 11/207,591, Final Office Action mailed Jan. 6, 2009", 13 pgs.
"U.S. Appl. No. 11/207,591, Final Office Action mailed Jan. 15, 2010", 13 pgs.
"U.S. Appl. No. 11/207,591, Non-Final Office Action mailed Jul. 14, 2009", 13 pgs.
"U.S. Appl. No. 11/207,591, Non-Final Office Action mailed Jul. 28, 2008", 11 pgs.
"U.S. Appl. No. 11/207,591, Non-Final Office Action mailed Nov. 16, 2007", 9 pgs.
"U.S. Appl. No. 11/207,591, Response filed May 6, 2008 to Non Final Office Action mailed Nov. 16, 2007", 8 pgs.
"U.S. Appl. No. 11/207,591, Response filed May 6, 2009 to Final Office Action mailed Jan. 6, 2009", 8 pgs.
"U.S. Appl. No. 11/207,591, Response filed Oct. 14, 2009 to Non Final Office Action mailed Jul. 14, 2009", 10 pgs.
"U.S. Appl. No. 11/207,591, Response filed Oct. 28, 2008 to Non Final Office Action mailed Jul. 28, 2008", 7 pgs.
"U.S. Appl. No. 11/207,591, Response filed Jun. 15, 2010 to Final Office Action mailed Jan. 15, 2010", 9 pgs.
"Euroepean Application Serial No. 08250941.5, Extended European Search Report mailed Aug. 18, 2010", 7 pgs.
"International Application Serial No. PCT/US2005/029793, International Search Report mailed Jan. 5, 2006", 7 pgs.
Haartsen, J., "Bluetooth—The Universal Radio Interface for Ad Hoc, Wireless Conncetivity", Ericsson Review, No. 3, (1998), 110-117.
Preves, D. A., "A Look at the Telecoil—It's Development and Potential", SHHH Journal, (Sep./Oct. 1994), 7-10.
"European Application Serial No. 08250941.5, Response filed Nov. 29, 2011 to Office Action mailed Aug. 1, 2011", 13 pgs.
"U.S. Appl. No. 12/982,526, Notice of Allowance mailed Apr. 3, 2013", 6 pgs.
"U.S. Appl. No. 12/982,526, Response filed Jan. 24, 2013 to Non Final Office Action mailed Oct. 24, 2012", 11 pgs.

* cited by examiner

SYSTEMS FOR PROVIDING POWER TO A HEARING ASSISTANCE DEVICE

TECHNICAL FIELD

This disclosure relates generally to hearing assistance devices, and more particularly to systems for providing power to hearing assistance devices.

BACKGROUND

Hearing assistance devices include hearing aids and other assistive listening devices and systems. Such devices are often compact, portable and traditionally utilize one-time-use batteries, since the energy density of these batteries has thus far been superior to rechargeable power sources. Recent breakthroughs in rechargeable batteries have made it possible to consider using them in hearing instruments. Hearing instruments worn behind the ear (BTE) and on the ear (OTE) are usually equipped with a standard Direct Audio Input (DAI) connector primarily for the purpose of connecting them to audio inputs such as assisted listening devices (ALDs) or assisted listening systems (ALSs). The ALDs and ALSs may include FM and Infrared systems as well as Bluetooth® equipped devices. These devices may require a power connection from the hearing instrument so the standard DAI connector includes a direct connection to the battery voltage within the hearing instrument. In addition to the battery connection, the DAI connector includes an audio input and ground.

Improved systems for providing power to hearing assistance devices are needed.

SUMMARY

Disclosed herein, among other things, is an apparatus for connection to a hearing assistance device having a DAI compatible interface compatible with direct audio input (DAI) signals. According to an embodiment, the apparatus includes a connector to connect to the DAI-compatible interface. The connector includes audio and ground connections compatible with the DAI-compatible interface. The connector further includes a power connection adapted to provide power to the hearing assistance device. The apparatus also includes a power source electrically connected to the connector.

Disclosed herein, among other things, is a hearing assistance device adapted to receive power from an external source. According to an embodiment, the device includes a microphone, a housing, and hearing assistance electronics disposed within the housing and in communication with the microphone to receive and process signals from the microphone. The device also includes a receiver in communication with the hearing assistance electronics to play processed signals from the hearing assistance electronics. The device further includes an interface compatible with direct audio input (DAI) signals, the interface further including a connection for receipt of electrical power from the external source. According to various embodiments, the external source is external to the housing.

Disclosed herein, among other things, is a method for recharging a hearing assistance device battery. According to an embodiment, the method includes connecting a power supply to a hearing assistance device having a direct audio input (DAI) connector. The method also includes charging a rechargeable battery via the DAI connector using the power supply, where the rechargeable battery is adapted to power the hearing assistance device.

Disclosed herein, among other things, is a method for providing power to a hearing assistance device. According to an embodiment, the method includes connecting a power supply to a hearing assistance device having a direct audio input (DAI) connector. The method also includes providing power to the hearing assistance device via the DAI connector using the power supply. According to various embodiments, providing power to the hearing assistance device includes providing power to supplement power provided by a battery for the hearing assistance device.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various"

embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

Figure 1A:
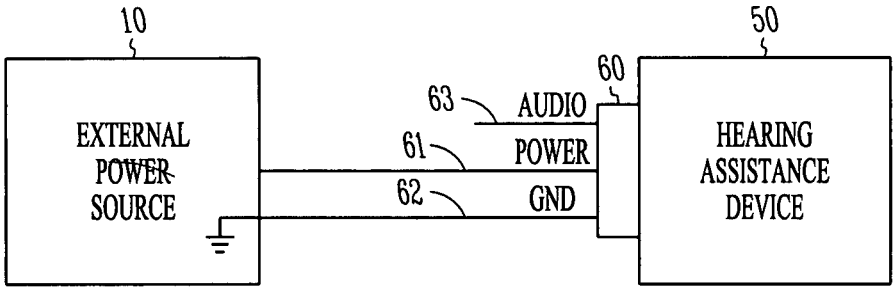
FIG. 1A illustrates a block diagram of a hearing assistance device and an external apparatus for providing power to the device, according to one embodiment of the present subject matter.

FIG. 1A illustrates a block diagram of a hearing assistance device 50 and an external apparatus 10 for providing power to the device, according to one embodiment of the present subject matter. The external power apparatus 10 is adapted to connect to a DAI connector 60 of the hearing assistance device. Power is provided from the external apparatus 10 to the hearing assistance device 50 via a power pin 61 and a ground pin 62 of the DAI connector 60. The DAI connector 60 includes a third pin, an audio pin 63, which is not connected to the external power apparatus 10 in the depicted embodiment. In varying embodiments, the external apparatus includes audio signal circuitry and the audio pin 63 is used to transfer audio signals between the apparatus 10 and the device 50.

Figure 1B:
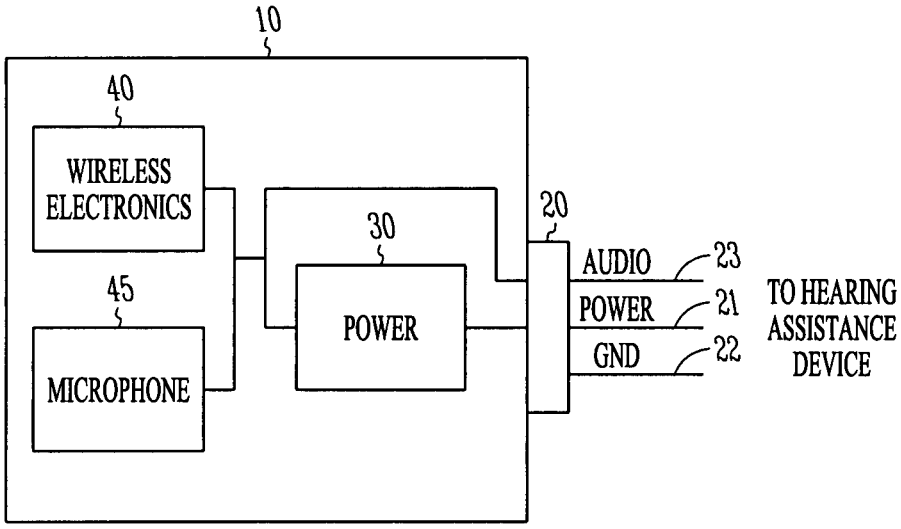
FIG. 1B illustrates a block diagram of an apparatus for providing power to a hearing assistance device, according to one embodiment of the present subject matter.

FIG. 1B illustrates a block diagram of an apparatus for providing power to a hearing assistance device, according to one embodiment. The apparatus 10 is adapted for connection to a hearing assistance device having a DAI compatible interface compatible with direct audio input (DAI) signals. According to an embodiment, the apparatus 10 includes a connector 20 to connect to the DAI-compatible interface. The connector 20 includes audio 23 and ground 22 connections compatible with the DAI-compatible interface. The connector 20 further includes a power connection 21 adapted to provide power to the hearing assistance device. The apparatus also includes a power source 30 electrically connected to the connector.

According to various embodiments, the power source 30 includes an energy storing device contained in a housing and the connector is mounted to the housing. Examples of energy storing devices include, but are not limited to, one-time-use batteries, capacitors, and inductors, and rechargeable batteries, capacitors, and inductors. While applicant uses the term battery for various examples, it will be understood by those skilled in the art that other types of energy storing devices can be used without departing from the scope of this disclosure. The power source, housing, and connector are adapted to be lightweight and portable such that the apparatus can be worn during use, according to an embodiment.

In varying embodiments, the power source 30 includes a power conditioning circuit. One type of power conditioning circuit is a regulator. A regulator can be used to control current, voltage and/or power provided by the power source. The power source is adapted to charge one or more energy storing device (such as batteries) within the hearing assistance device, according to an embodiment. In another embodiment, the power source includes a battery disposed within a housing and the connector is attached to the battery, and the power source includes power conditioning circuit, such as a regulator, to control power delivered by the apparatus for controllably powering or charging or powering and charging the hearing assistance device. The apparatus 10 further includes wireless communication electronics 40 and/or a microphone 45, in various embodiments. The power source with the apparatus includes rechargeable energy storing devices (such as rechargeable batteries), in an embodiment. In various embodiments, the power source includes one-time-use energy storing devices.

Figure 1C:
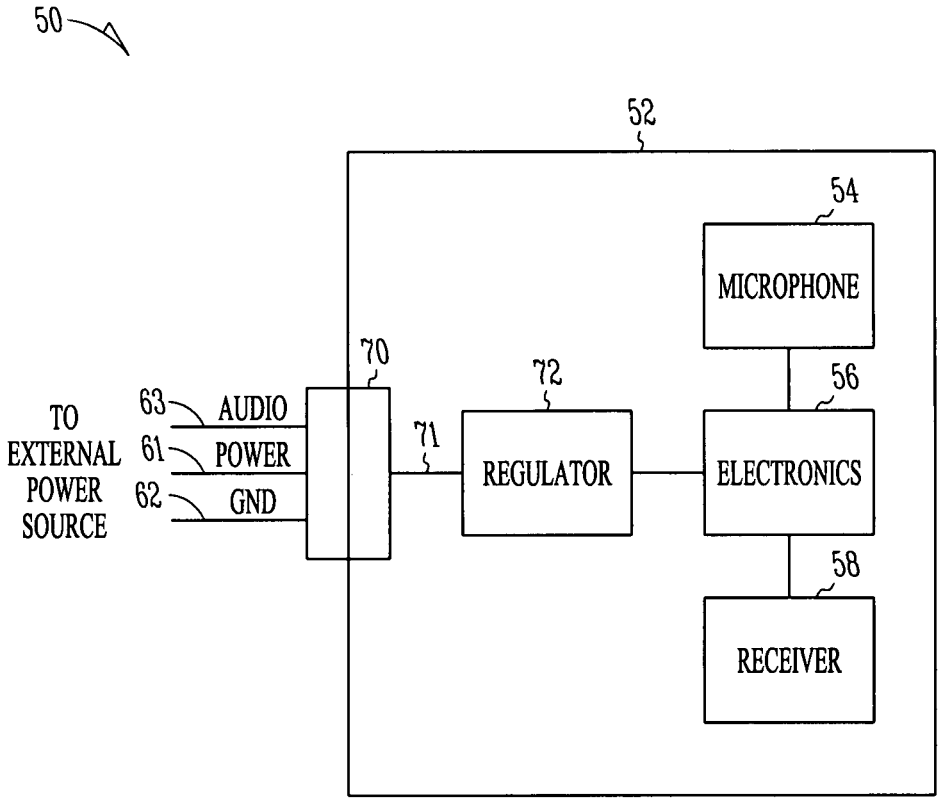
FIG. 1C illustrates a block diagram of a hearing assistance device adapted to receive power from an external source, according to one embodiment of the present subject matter.

FIG. 1C illustrates a block diagram of a hearing assistance device 50 adapted to receive power from an external source, according to one embodiment. According to an embodiment, the device 50 includes a microphone 54, a housing 52, and hearing assistance electronics 56 disposed within the housing and in communication with the microphone to receive and process signals from the microphone. The device also includes a receiver 58 in communication with the hearing assistance electronics 56 to play processed signals from the hearing assistance electronics. The device further includes an interface 70 compatible with direct audio input (DAI) signals, the interface 70 further including a connection 71 for receipt of electrical power from the external source. According to various embodiments, the external source is external to the housing 52.

According to various embodiments, the device 50 further includes a power conditioning circuit, such as regulator 72, for regulating electrical power received from the external source. The hearing assistance device 50 further includes one or more batteries and battery charging electronics adapted to charge the one or more batteries using power from the external source, according to an embodiment. According to an embodiment, the hearing assistance device 50 further includes one or more batteries disposed within the housing and battery charging electronics adapted to controllably supplement power provided to the hearing assistance electronics by the one or more batteries with power from the external source. The hearing assistance device 50 further includes one or more batteries disposed within the housing and battery charging electronics adapted to bypass the one or more batteries to connect the hearing assistance electronics to power from the external source, in varying embodiments.

Figure 2A:
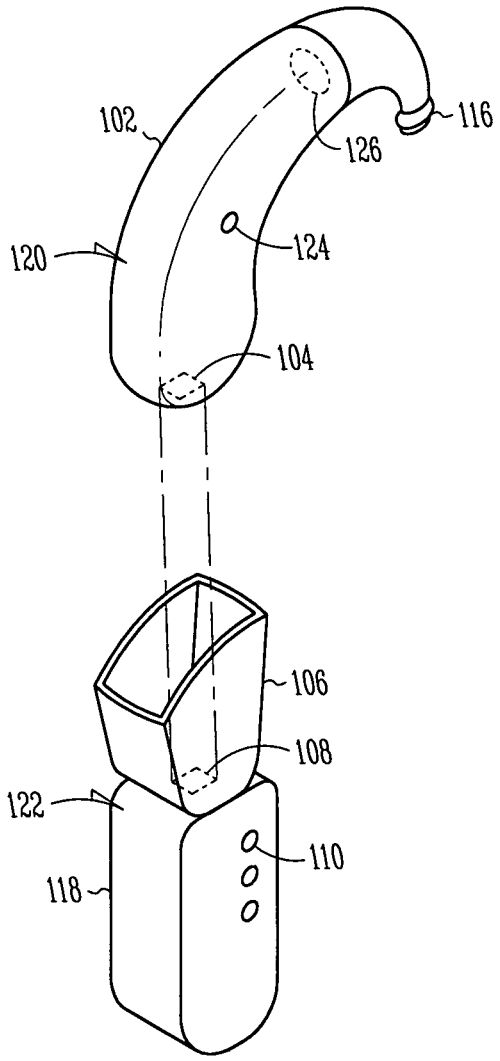
FIG. 2A illustrates a perspective view of a connected hearing assistance device and power supply apparatus, according to one embodiment of the present subject matter.

FIG. 2A illustrates a perspective view of a connected hearing assistance device 120 and power supply adapter 122, according to one embodiment. The power supply adapter 122 is designed to connect to the hearing assistance device 120. In varying embodiments, a system for providing power to an existing hearing assistance device 120 includes a hearing assistance device housing 102 sized for mating with a human ear, the mass of the hearing assistance device 120 supportable by the human ear. In one example, the hearing assistance device housing 102 is a self-powered behind-the-ear hearing assistance device. In the example, the hearing assistance device housing 102 includes hearing assistance device electronics, a hearing assistance device speaker 126, a hearing assistance device port 116 for transmitting sound to an earpiece, a hearing assistance device microphone 124 and a hearing assistance device connector 104.

The connector 104 provides for a wired connection in varying examples. In one embodiment, the connector 104 includes pads, such as gold plated metallic pads, suitable for forming multiple connections with terminals, such as spring-loaded pin-shaped terminals. However, in additional examples, the hearing assistance device connector 104 includes a mechanical lock. In various embodiments, the mechanical lock is releasable. In one example, the mechanical lock is constructed to support the weight of a mating connector and its associated components.

In one embodiment, the hearing assistance device connector 104 is a Direct Audio Input (DAI) type connector 104. In some varying designs, a connector is formed to mate with the DAI connector which includes a "boot" that surrounds at least a portion of the DAI connector. In embodiments involving behind-the-ear hearing aids, the boot may also mechanically interface with the lower portion of the behind-the-ear hearing aid proximal the DAI connector. In varying embodiments the boot includes silicon or plastic. Such embodiments can be adapted to support at least some or all of the weight of the components attached to the boot. In various embodiments, the boot serves to improve comfort. The Direct Audio Input, in varying embodiments, is connected to hearing assistance device electronics which can control varying aspects of hearing assistance device function.

Mateable to the hearing assistance device 120 is a power supply adapter 122. In varying embodiments, the power supply adapter 122 includes a power supply adapter connector 108 and a boot 106 which forms a mechanical connection with the hearing assistance device housing 102. In varying embodiments, the boot 106 and the connector 108 form components typical of DAI connector sets, however, the present subject matter is not limited to these variants. In varying examples, connector 108 combined with the boot 106 is suited to use fricative cohesion, adhesives, elastic deformation of the boot, or any combination of these to form a mechanical connection with the hearing assistance device 120, with or without the assistance of the hearing assistance device connector 104. Although many embodiments use the boot 106, others do not, and, in general, the examples listed here should not be understood to be exhaustive or exclusive. Another embodiment without a boot will be demonstrated by FIG. 3A and its related figures and description provided below.

The power supply adapter 122 includes a power supply adapter housing 118, in varying examples, which contains a power source. In varying embodiments, the electronics operate independent of notification to a user, but some embodiments communicate information to the user using visual indicators 110, or other types of indicators.

Figure 2B:
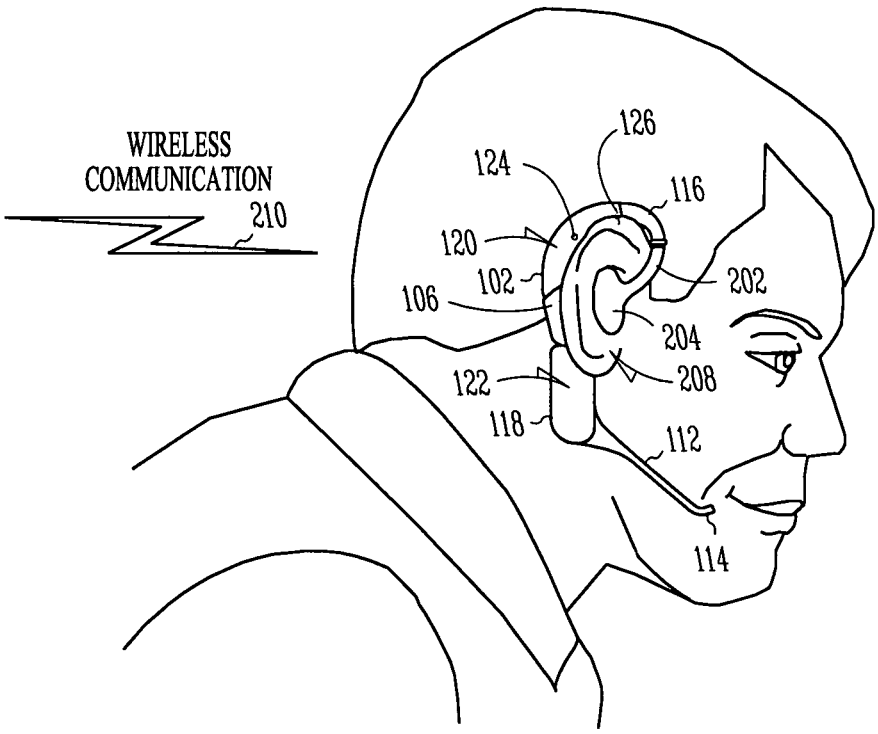
FIG. 2B illustrates a perspective view of a hearing assistance system, according to one embodiment of the present subject matter.

FIG. 2B illustrates a perspective view of a hearing assistance system, according to one embodiment. FIG. 2B illustrates the hearing assistance device 120 connected to the power supply adapter 122, and further illustrates a connected hearing assistance device 120 and power supply adapter 122 mounted on an ear 208 of a user. In varying designs, the power supply adapter 122 and hearing assistance device 120 are sized for comfortable use on an ear 208, including aspects which restrict the mass of the apparatus. The illustration also demonstrates one embodiment of a tube 202 for conducting sound to an earpiece 204, the earpiece custom fitted to the user, which, in varying examples, allows for a standardized hearing assistance device 120. Other earpieces, such as vented designs, are contemplated without departing from the scope of the present subject matter.

According to various embodiments, the power supply adapter includes wireless communication circuitry and is adapted to facilitate wireless communication of information 210 with a remote device (not shown). One example using wireless communication from this type of adapter is discussed in commonly owned U.S. patent application Ser. No. 11/207,591, "Wireless Communications Adapter for a Hearing Assistance Device", which is hereby incorporated by reference in its entirety. When used as a communications adapter, some embodiments of the power supply adapter include a boom 112 and a microphone 114, the boom 112 extending away from the power supply adapter housing 118 to a distal end. The microphone 114 is shown positioned at the distal end of the boom 112, but the microphone can be positioned elsewhere without departing from the scope of this disclosure.

Figure 3A:
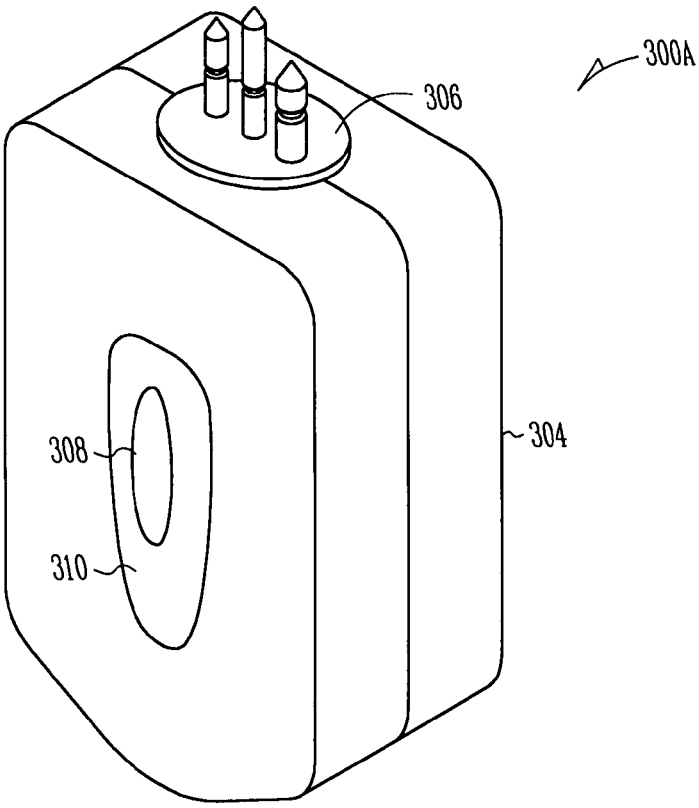
FIG. 3A illustrates a perspective view of a power supply apparatus, according to one embodiment of the present subject matter.
Figure 3B:
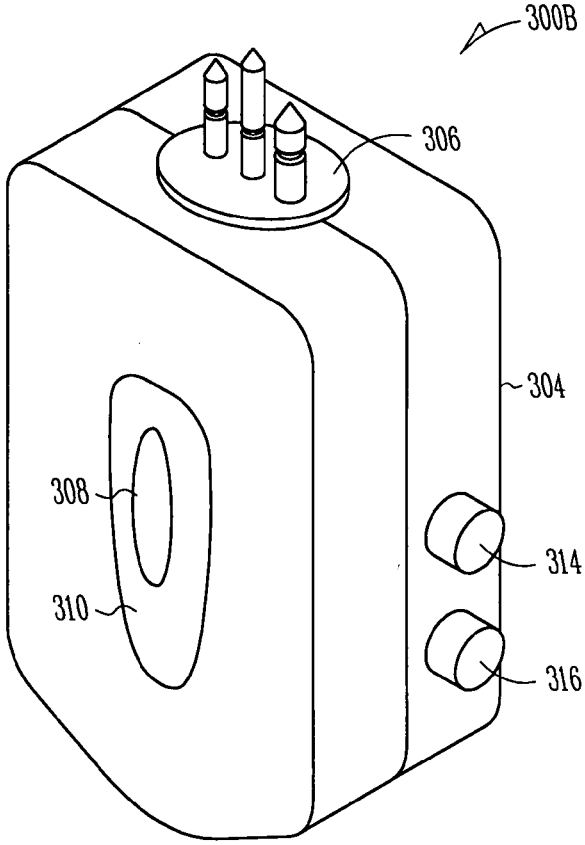
FIG. 3B illustrates a perspective view of a power supply apparatus, according to one embodiment of the present subject matter.

FIG. 3A illustrates a perspective view of a power supply adapter, according to one embodiment. In one embodiment, the power supply adapter 300A includes a DAI connector 306. In some embodiments, the connector 306 may be adjustable so that it can swivel to position the power supply adapter 300A at different angles to the device connected to connector 306. In various embodiments, the power supply adapter 300A includes a housing 304 including one or more buttons 310 to perform functions. The wireless communication adapter 300A, in various embodiments, also includes one or more indicators 308 to indicate aspects of the operation of the device. Placement and types of buttons and indicators may vary without departing from the scope of the present subject matter. FIG. 3B illustrates another variation of a power supply adapter 300B including the aspects set forth for power supply adapter 300A and including an optional volume control 314 and an optional accessory port 316. The position and types of volume control 314 and port 316 may vary without departing from the scope of the present subject matter.

Thus, the power supply adapter may be embodied in several designs having varying form factors and features without departing from the scope of the present subject matter.

Figure 4A:
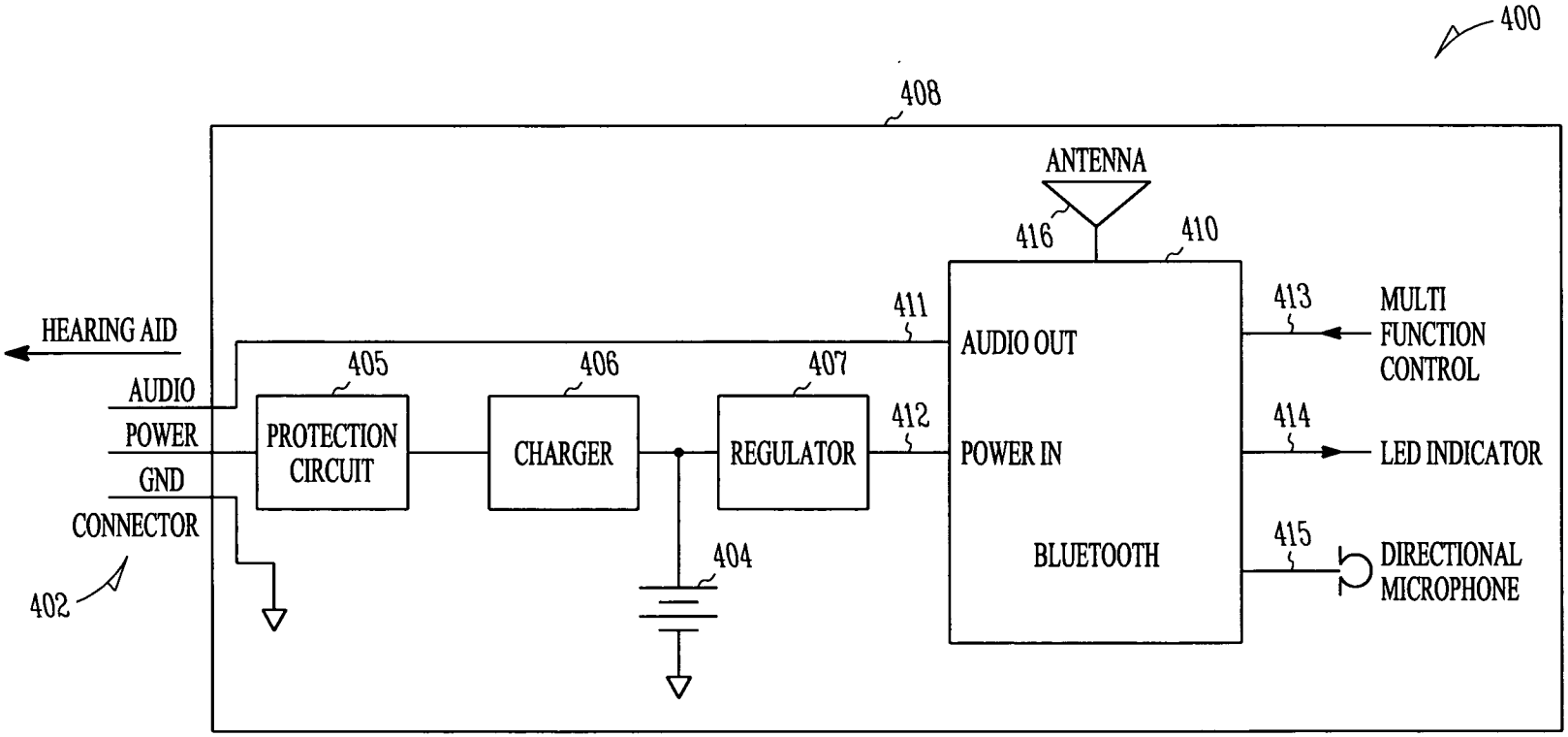
FIG. 4A illustrates a block diagram of a power charger apparatus, according to one embodiment of the present subject matter.

FIG. 4A illustrates a block diagram of a power charger adapter apparatus, according to one embodiment. The apparatus 400 includes a connector 402 adapted to electrically connect to the direct audio input (DAI) connector of a hearing assistance device. In the present embodiment, the connector 402 has three pins, one for audio, one for power, and one for ground. The apparatus 400 also includes a power source 404 adapted to provide power to the apparatus and to provide power to a charger 406 to charge a rechargeable battery (not shown) via the DAI connector. The rechargeable battery is adapted to power the hearing assistance device, according to an embodiment. The apparatus also includes a housing 408 for the power source 404 and the charger 406, and the housing is adapted to accommodate the connector 402. According to various embodiments, the apparatus is adapted to be compact and portable. The power source 404 may include a battery, such as a disposable or rechargeable battery in varying embodiments. If a rechargeable battery is used for the adapter, it can be recharged through a direct connection or an inductive charging system.

According to one embodiment, the apparatus 400 also includes a controller (not shown) adapted to communicate with the audio pin of the DAI connector 402, and wireless communication electronics 410 adapted for radio frequency communications and for communication with the controller. The housing 408 is adapted to accommodate the controller and the wireless communication electronics 410. In the depicted embodiment, the wireless communication electronics 410 includes a Bluetooth set with input and outputs including, but not limited to, audio out 411, power in 412, multifunction control 413, LED indicator 414, directional microphone 415, and antenna 416. Other types of wireless communication electronics for other types of wireless communication (inductive telemetry, infrared, FM, RF, for example) are within the scope of this disclosure. The wireless communication electronics may also reside in a housing separate from the apparatus housing 408, according to varying embodiments. In one embodiment, the apparatus 400 also includes a regulator 407 connected between the power source 404 and the wireless communication electronics 410, the regulator adapted to regulate power supplied by the power source to the communication electronics. The apparatus 400 also includes a protection circuit 404 connected between the charger 406 and the DAI connector 402, the protection circuit adapted to prevent current drain from the rechargeable battery. In the depicted embodiment, the rechargeable battery is external to the apparatus, for powering the hearing assistance device. Charging the rechargeable battery includes providing power from an AC/DC adapter, in various embodiments.

According to various embodiments, the hearing assistance device connected to the adapter apparatus is configured to accept power through a pin on its DAI connector. The hearing assistance device includes a diode or other type of regulator at this input to prevent current drain and allow incoming current for powering and/or recharging the hearing assistance device.

Figure 4B:
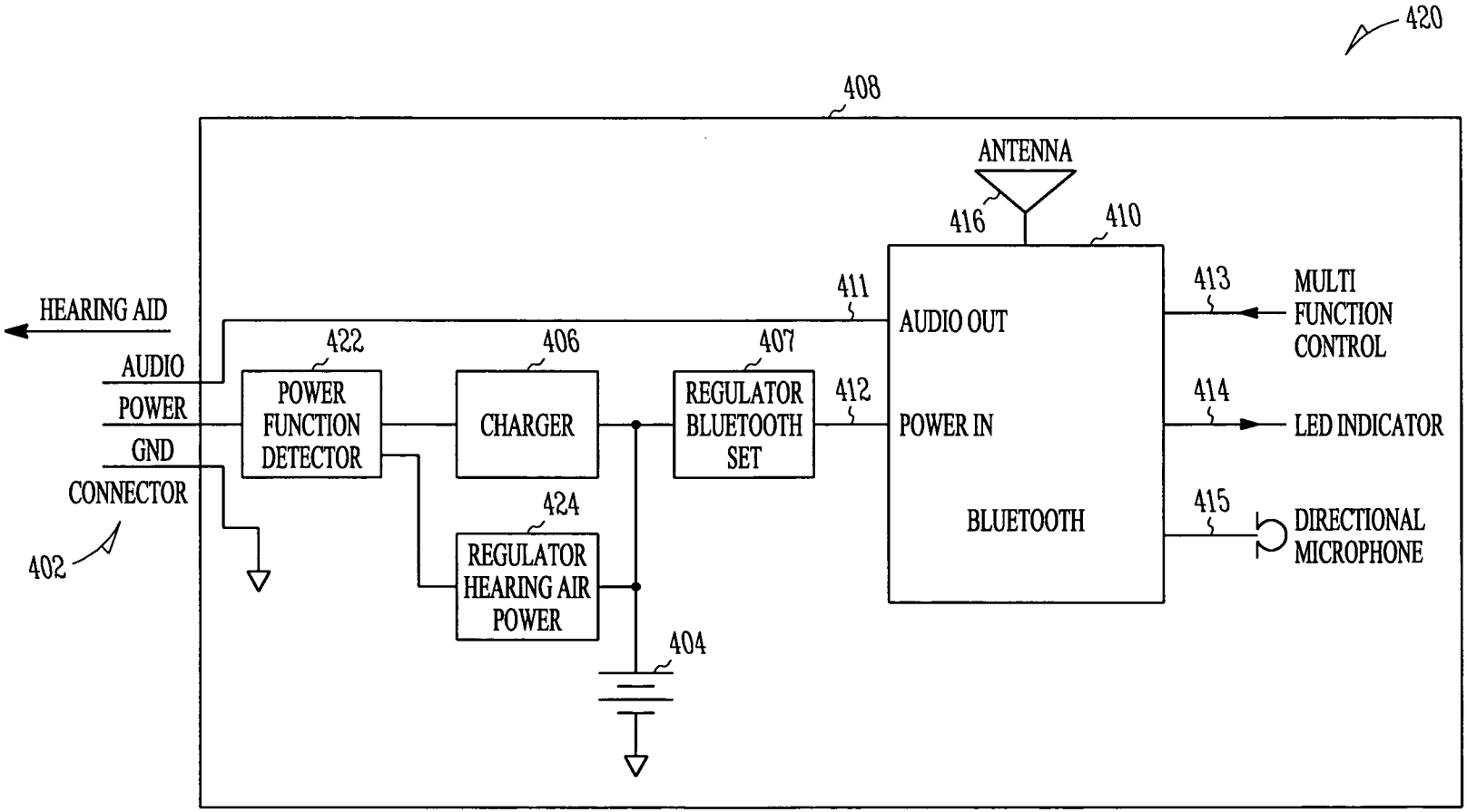
FIG. 4B illustrates a block diagram of a power supply and charger apparatus, according to one embodiment of the present subject matter.
Figure 4C:
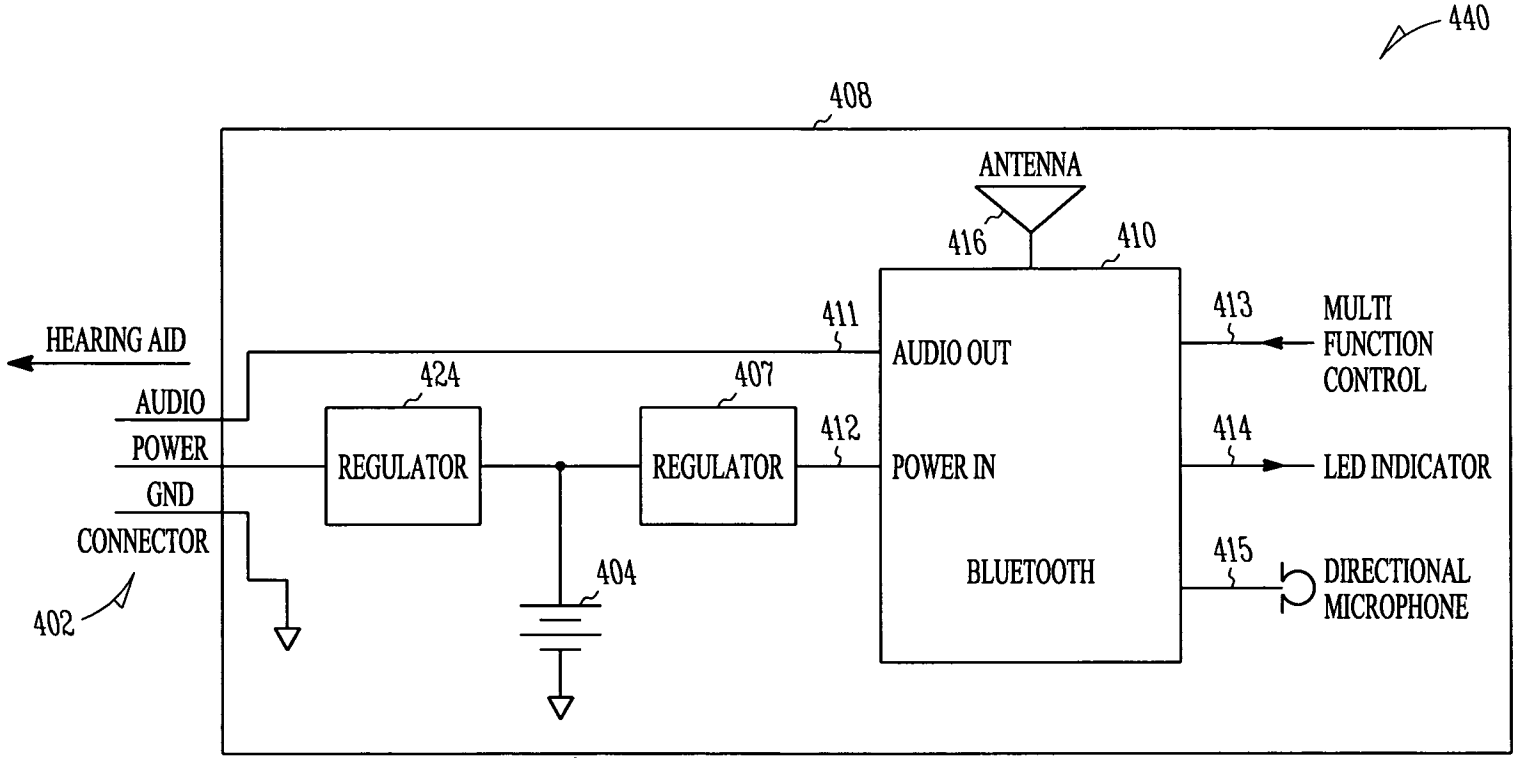
FIG. 4C illustrates a block diagram of a power supply apparatus, according to one embodiment of the present subject matter.

FIG. 4C illustrates a block diagram of a power supply adapter apparatus, according to one embodiment. The apparatus 440 includes a connector 402 adapted to electrically connect to the direct audio input (DAI) connector of a hearing assistance device. The apparatus 440 also includes a power source 404 adapted to provide power to the apparatus and to provide power to the hearing assistance device via the DAI connector. The apparatus further includes a housing 408 for the power source, the housing adapted to accommodate the connector 402. According to various embodiments, the apparatus is adapted to be compact and portable.

The apparatus 440 further includes a regulator 424 connected between the power source 404 and the DAI connector 402, according to various embodiments, The regulator 424 is adapted to regulate power supplied by the power source to the hearing aid. According to an embodiment, the power source 404 includes a rechargeable power source. In some embodiments, the hearing assistance device includes a battery, so that the apparatus 440 provides supplemental power to the device. In other embodiments, the hearing assistance device does not include a battery, so that the apparatus 440 provides the primary power source to the device.

FIG. 4B illustrates a block diagram of a power supply and charger adapter apparatus, according to one embodiment. In this embodiment, the apparatus 420 includes the functions of a charger (as in FIG. 4A) and power supply (as in FIG. 4C). The power source 404 is adapted to provide power to the hearing assistance device via the DAI connector and is further adapted to provide power to a charger 406 to charge a rechargeable battery via the DAI connector, wherein the rechargeable battery (external to the apparatus) is adapted to power the hearing assistance device. The apparatus 420 further includes a switching means, such as power function detector 422, connected between the DAI connector 402, the regulator 424, and the charger 406, the switching means adapted to place the apparatus in either a charging or powering mode for supplying the hearing assistance device via the DAI connector. According to varying embodiments, the switching means may be programmable, user selectable, and may be a hardware or software switch.

The power function detector 422 includes sensing circuitry, according to various embodiments. The detector 422 senses power, voltage and/or current from the hearing assistance device, in varying embodiments. If a sensed value (of power, voltage or current) is below a programmable threshold, the detector 422 causes the power source within the DAI adapter to switch on and supply power for the hearing assistance device either for normal operation, or for charging a rechargeable energy storing device in the hearing assistance device, or for a combination of charging and operating the device, in various embodiments. The detector 422 makes various impedance measurements to determine the proper method for recharging the power source in the device, in an embodiment.

Figure 5:
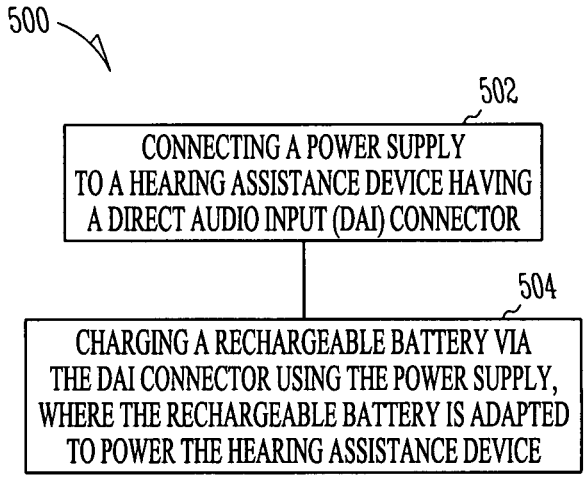
FIG. 5 illustrates a flow diagram of a method for recharging a hearing assistance device battery, according to one embodiment of the present subject matter.

FIG. 5 illustrates a flow diagram of a method for recharging a hearing assistance device battery, according to one embodiment. According to an embodiment, the method 500 includes connecting a power supply to a hearing assistance device having a direct audio input (DAI) connector, at 502. The method also includes charging a rechargeable battery via the DAI connector using the power supply, where the rechargeable battery is adapted to power the hearing assistance device, at 504.

According to various embodiments, the method further includes providing power to the hearing assistance device via the DAT connector using the power supply. In one embodiment, the method also includes switching from charging to providing power using a user selectable switch. In another embodiment, the method includes switching from charging to providing power based on a sensed parameter measured from the hearing assistance device via the DAI connector. The method includes transferring audio from the hearing assistance device to wireless communication electronics via the DAI connector using the power supply, and in an embodiment the wireless communication electronics are housed with the power supply. Charging a rechargeable battery includes providing power from an AC/DC adapter, according to various embodiments.

Figure 6:
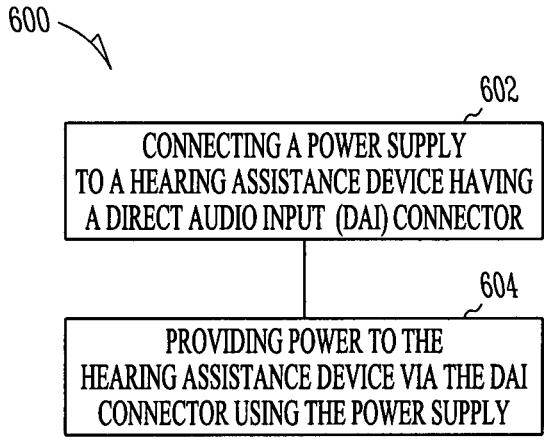
FIG. 6 illustrates a flow diagram of a method for providing power to a hearing assistance device, according to one embodiment of the present subject matter.

FIG. 6 illustrates a flow diagram of a method for providing power to a hearing assistance device, according to one embodiment. According to an embodiment, the method 600 includes connecting a power supply to a hearing assistance device having a direct audio input (DAI) connector, at 602. The method also includes providing power to the hearing assistance device via the DAI connector using the power supply, at 604. According to various embodiments, providing power to the hearing assistance device includes providing power to supplement power provided by a battery for the hearing assistance device.

According to an embodiment, the method also includes charging a rechargeable energy storing device, such as a battery, via the DAI connector using the power supply, where the rechargeable battery is adapted to power the hearing assistance device, and where a user selects charging or providing power. Providing power to the device includes using a ground pin and a power pin of the DAI connector, according to various embodiments. In one embodiment, the method includes providing power to wireless communication electronics, the wireless communication electronics within a housing of the power supply apparatus and adapted to receive audio from the hearing assistance device via the DAI connector. Providing power to the hearing assistance device includes using a rechargeable energy storing device, such as a battery, housed with the power supply, in various embodiments.

Variations of order, information or connections are possible without departing from the present teachings. The systems shown and described herein can be implemented using software, hardware, and combinations of software and hardware.

Although specific embodiments have been illustrated and described herein, this application is intended to cover adaptations or variations of the present subject matter. It is to be understood that the above description is intended to be illustrative, and not restrictive. The scope of the present subject matter should be determined with reference to the appended claims, along with the full scope of equivalents to which such claims are entitled.

We claim:

1. An apparatus for connection to a hearing assistance device having a DAI compatible interface compatible with direct audio input (DAI) signals, comprising:

a connector to connect to the DAI-compatible interface, the connector including audio and ground connections compatible with the DAI-compatible interface and a power connection adapted to provide power to the hearing assistance device;

a power source electrically connected to the connector;

wireless communication electronics; and a microphone, wherein the power source is adapted to charge one or more batteries within the hearing assistance device.

2. The apparatus of claim 1, wherein the power source includes a battery contained in a housing and the connector is mounted to the housing.

3. The apparatus of claim 2, wherein the power source, housing, and connector are adapted to be lightweight and portable such that the apparatus can be worn during use.

4. The apparatus of claim 3, wherein the power source includes a power conditioning circuit to control current provided by the power source.

5. The apparatus of claim 3, wherein the power source includes a power conditioning circuit to control voltage provided by the power source.

6. The apparatus of claim 3, wherein the power source includes a power conditioning circuit to control power provided by the power source.

7. The apparatus of claim 1, wherein the power source includes a battery disposed within a housing and the connector is attached to the battery, and wherein the power source includes a regulator to control power delivered by the apparatus for controllably powering or charging or powering and charging the hearing assistance device.

8. The apparatus of claim 1, wherein the power source is adapted to transfer energy to an energy storing device within the hearing assistance device.

9. A hearing assistance device adapted to receive power from an external source, comprising:

a microphone;

a housing;

hearing assistance electronics disposed within the housing and in communication with the microphone to receive and process signals from the microphone;

a receiver in communication with the hearing assistance electronics to play processed signals from the hearing assistance electronics;

an interface compatible with direct audio input (DAI) signals, the interface further including a connection for receipt of electrical power from the external source; and a power conditioning circuit for regulating electrical power received from the external source, wherein the external source is external to the housing and includes wireless communication electronics and a microphone.

10. The hearing assistance device of claim 9, further comprising:

one or more batteries disposed within the housing; and battery charging electronics adapted to charge the one or more batteries using power from the external source.

11. The hearing assistance device of claim 9, further comprising:

one or more batteries disposed within the housing; and battery charging electronics adapted to controllably supplement power provided to the hearing assistance electronics by the one or more batteries with power from the external source.

12. The hearing assistance device of claim 9, further comprising:

one or more batteries disposed within the housing; and battery charging electronics adapted to bypass the one or more batteries to connect the hearing assistance electronics to power from the external source.

13. A method, comprising:

connecting a power supply to a hearing assistance device having a direct audio input (DAI) connector;

charging a rechargeable battery via the DAI connector using the power supply, wherein the rechargeable battery is adapted to power the hearing assistance device;

providing power to the hearing assistance device via the DAI connector using the power supply;

regulating electrical power received from the external source using a power conditioning circuit; and switching from charging to providing power using a user selectable switch.

14. The method of claim 13, further comprising:

switching from charging to providing power based on a sensed parameter measured from the hearing assistance device via the DAI connector.

15. The method of claim 13, further comprising:

transferring audio from the hearing assistance device to wireless communication electronics via the DAI connector using the power supply.

16. The method of claim 15, wherein the wireless communication electronics are housed with the power supply.

17. The method of claim 13, wherein charging a rechargeable battery includes providing power from an AC/DC adapter.

18. A method, comprising:

connecting a power supply to a hearing assistance device having a direct audio input (DAI) connector;

providing power to the hearing assistance device via the DAI connector using the power supply; and charging a rechargeable energy storing device via the DAI connector using the power supply, wherein the rechargeable energy storing device is adapted to power the hearing assistance device, and wherein a user selects charging or providing power.

19. The method of claim 18, wherein providing power to the device includes using a ground pin and a power pin of the DAI connector.

20. The method of claim 18, further comprising:

providing power to wireless communication electronics, the wireless communication electronics within a housing of the power supply and adapted to receive audio from the hearing assistance device via the DAI connector.

21. The method of claim 18, wherein providing power to the hearing assistance device includes using a rechargeable energy storing device.

22. The method of claim 18, wherein providing power to the hearing assistance device includes providing power to supplement power provided by a battery for the hearing assistance device.

23. An apparatus for connection to a hearing assistance device having a DAI compatible interface compatible with direct audio input (DAI) signals, comprising:

a connector to connect to the DAI-compatible interface, the connector including audio and ground connections compatible with the DAI-compatible interface and a power connection adapted to provide power to the hearing assistance device;

a power source electrically connected to the connector;

wireless communication electronics; and a microphone, wherein the power source is adapted to transfer energy to an energy storing device within the hearing assistance device.

24. A hearing assistance device adapted to receive power from an external source, comprising:

a microphone;

a housing;

hearing assistance electronics disposed within the housing and in communication with the microphone to receive and process signals from the microphone;

a receiver in communication with the hearing assistance electronics to play processed signals from the hearing assistance electronics;

an interface compatible with direct audio input (DAI) signals, the interface further including a connection for receipt of electrical power from the external source;

one or more batteries disposed within the housing; and battery charging electronics adapted to charge the one or more batteries using power from the external source, wherein the external source is external to the housing and includes wireless communication electronics and a microphone.

25. A hearing assistance device adapted to receive power from an external source, comprising:

a microphone;

a housing;

hearing assistance electronics disposed within the housing and in communication with the microphone to receive and process signals from the microphone;

a receiver in communication with the hearing assistance electronics to play processed signals from the hearing assistance electronics;

an interface compatible with direct audio input (DAI) signals, the interface further including a connection for receipt of electrical power from the external source one or more batteries disposed within the housing; and battery charging electronics adapted to controllably supplement power provided to the hearing assistance electronics by the one or more batteries with power from the external source, wherein the external source is external to the housing and includes wireless communication electronics and a microphone.

26. A hearing assistance device adapted to receive power from an external source, comprising:

a microphone;

a housing;

hearing assistance electronics disposed within the housing and in communication with the microphone to receive and process signals from the microphone;

a receiver in communication with the hearing assistance electronics to play processed signals from the hearing assistance electronics;

an interface compatible with direct audio input (DAI) signals, the interface further including a connection for receipt of electrical power from the external source one or more batteries disposed within the housing; and battery charging electronics adapted to bypass the one or more batteries to connect the hearing assistance electronics to power from the external source, wherein the external source is external to the housing and includes wireless communication electronics and a microphone.

* * * * *